US006971789B2

(12) United States Patent
Nakamura

(10) Patent No.: US 6,971,789 B2
(45) Date of Patent: Dec. 6, 2005

(54) TIMEPIECE

(75) Inventor: Hisao Nakamura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 211 days.

(21) Appl. No.: 10/446,923

(22) Filed: May 28, 2003

(65) Prior Publication Data

US 2003/0231558 A1 Dec. 18, 2003

(30) Foreign Application Priority Data

May 30, 2002 (JP) ..... 2002-156882

(51) Int. Cl.[7] ..... G04B 29/00

(52) U.S. Cl. ..... 368/300; 368/88; 368/297; 368/281; 368/299

(58) Field of Search ..... 368/300, 88, 297, 368/299, 281

(56) References Cited

U.S. PATENT DOCUMENTS 2,719,403 A * 10/1955 Gisiger ..... 368/291
3,727,367 A * 4/1973 Fujimori et al. ..... 368/287
4,181,317 A * 1/1980 Toda ..... 280/42
4,205,523 A * 6/1980 Ida ..... 368/281
4,276,630 A * 6/1981 Paratte ..... 368/88
4,970,708 A * 11/1990 Gagnebin et al. ..... 368/300
5,363,350 A * 11/1994 Marr-Andre et al. ..... 368/276
5,657,298 A * 8/1997 Choay ..... 368/276
6,357,908 B1 * 3/2002 Hunziker ..... 368/287
6,575,619 B1 * 6/2003 Stauffer ..... 368/299
6,616,329 B1 * 9/2003 Sasaki et al. ..... 368/294

FOREIGN PATENT DOCUMENTS

CH 688926 A3 * 6/1998 ..... G04B 37/04

* cited by examiner

*Primary Examiner*—Andrew H. Hirshfeld
*Assistant Examiner*—Andrea H. Evans
(74) *Attorney, Agent, or Firm*—Adams & Wilks

(57) ABSTRACT

A thin timepiece having a module stably fixed therein has a case integrated with a wrist band and a case back, the case having an opening portion on a front surface side thereof, a module having a housing formed of a resin and a timepiece movement held by the housing, the module being removable retained in the opening portion of the case, and a cover glass for covering the opening portion of the case. The housing has at least one two-sided supporting beam integrally formed in a side surface therof and being deformable in a planar direction of the housing, and a fitting projection protruding from each two-side suporting beam, and the module is fixed in the opening portion of the case by inserting the fitting projection into a corresponding engaging recess formed in an inner side face of the case.

12 Claims, 4 Drawing Sheets

TIMEPIECE

BACKGROUND OF THE INVENTION

The present invention relates to a module fixing structure of a timepiece for integrating and fixing a module to a case having a one-piece structure integrated with a case band and a case back from an opening portion for containing the module on a side of cover glass.

A timepiece containing a module fixed to a case having a one-piece structure integrated with a case band and a case back; that is, a case formed with an opening portion for containing the module on a side of cover glass has an advantage in that the structure is simple and a waterproof seal may be more easily provided between the cover glass and the case. This structure is advantageous in comparison with a timepiece in which a case band and a case back are separated from each other and a module is contained and fixed to a case formed with opening portions for both of a side of a cover glass and a side of a case back. However, according to the former module fixing structure, the contained module needs to be held and fixed at a bottom face or an inner side face of the case and therefore, the former is more complicated than the latter in that respect.

That is, according to a module fixing structure disclosed in JP-H02-93790-U a stepped portion is formed on an upper side of an inner side wall of a case formed by resin and the stepped portion is formed with a plurality of upwardly extending projections. Meanwhile, a module is formed with a flange portion at side face thereof. When the module is integrated to the case, a lower face of the flange portion is arranged to be brought into contact with the stepped portion. Further, the projections are fixed to the flange portion by thermal caulking to thereby hold and fix the contained module at an inner side face of the case.

Owing to such a fixing structure, the module is stably fixed to the case. However, there poses a problem that according to such a fit-to-set fixing structure, the module cannot be removed from outside. Further, the case is formed with the stepped portion brought into contact with the lower face of the flange portion of the module and therefore, a thickness between the inner side face and an outer side face of the case is increased by an amount of the stepped portion and therefore, there poses a problem that the case becomes large-sized and cannot be adopted for a small-sized timepiece.

Next, there is a module fixing structure disclosed in JP-H09-189776 formed with at least two recessed portions at an inner side face of a case formed by resin. Further, the recessed portion is provided with a ceiling face. Meanwhile, a module is formed with hook portions projected outwardly from a side wall portion thereof and formed with at least two cantilever type hook portions bent to an inner diameter direction of the module. Further, the cantilever type hook portion is of a shape constituting a ceiling face engaging portion engaged with the ceiling face of the recessed portion by a portion of an upper end face of a movable end portion thereof. When the module is integrated to the case, the cantilever type hook portion is bent to the inner diameter direction by being brought into contact with the inner side face of the case, however, when the module is contained at a predetermined position, the cantilever type hook portion recovers to an original shape by elasticity in an outer diameter direction and fitted to the recessed portion of the inner side face of the case to thereby hold and fix the contained module at the inner side face of the case.

Owing to such a fixing structure, the module is fixed to the case. However, the module is formed with the hook portions projected outwardly from the side wall portion and formed with at least the two cantilever type hook portions bent to the inner diameter direction of the module and therefore, a thickness between the inner side face and the outer side face of the case is increased and therefore, there is a problem in that the case becomes large-sized and cannot be adopted for a small-sized timepiece. The increased thickness in this case consists of a total thickness of the hook portion and therefore, is a total of at least a thickness of an upper end portion of the movable end portion of the cantilever type hook portion and an amount of bending of the movable end portion to the inner diameter direction.

Meanwhile, the module fixing structure disclosed in JP-H09-189776 is not a fit-to-set fixing structure and therefore, the module can be removed from outside. That is, a portion of the upper end face of the movable end portion of the cantilever type hook portion is formed with the ceiling face engaging portion for engaging with the ceiling face of the recessed portion and formed with a hook off portion. The movable end portion of the cantilever type hook portion is bent to the inner diameter direction by inserting an engagement releasing jig from a knotched portion formed at the case and pressing the jig to the hook off portion or making the hook off portion catch the jig. Then, fitting of the cantilever type hook portion and the recessed portion is released and the module can be removed from the case to outside.

However, since the hook portion is the cantilever type hook portion, when the movable end portion is repeatedly bent, the hook portion cannot be recovered to the original shape by reducing the elasticity by plastic deformation and there poses a problem that the module cannot firmly be fixed to the case by fitting. Therefore, there poses a problem that it is difficult to stably fix the module to the case, detachment of the fitting is brought about when a product is dropped, or the module is inclined after having been integrated. Further, since the portion of the upper end face of the movable end portion of the cantilever type hook portion is formed with the ceiling face engaging portion for engaging with the ceiling face of the recessed portion and formed with the hook off portion, a housing of the module is constituted by a considerably complicated shape and therefore, there also poses a problem that the cost of a die for fabricating the housing by resin molding becomes necessarily increased.

A problem to be resolved by the invention is to provide a module fixing structure for stably fixing a module to a case having a one-piece structure and making a thickness between an inner side face and an outer side face of the case thinner than that of a conventional timepiece of this type.

SUMMARY OF THE INVENTION

In order to resolve the above-described problem, in a timepiece comprising a case integrated with a case band and a case back and having an opening portion for containing a module on a surface side, a module having a housing made of a resin and contained in the case and cover glass for covering the opening portion of the case, the module is fixed to the case by fitting the fitting projected portions formed at portions of elastically deformed portions in a shape of a two ends supporting beam integrally formed at a side face of the housing and deformed in a planar direction to a plurality of engaging recessed portions formed at an inner side face of the case.

Fitting of the fitting projected portions and its corresponding engaging recessed portions is carried out at at least three locations spaced apart from each other by predetermined intervals so that housing does not incline inside the case. Or, fitting of the fitting projected portions and its corresponding engaging recessed portions achieves an inclination preventing operation of the housing and carried out at at least two locations opposed to each other.

The fitting projected portion is a projection in a tapered shape spreading to a side of the cover glass and the module is made to be smoothly integrated to the case from an only opening portion.

Fitting projected portion is formed in a shape of an inverse cone and only an apex of a circular arc is brought into contact with the inner side face of the case when integrated. Therefore, an elastically deformed portion of the housing in containing a movement is smoothly deformed and a performance of integrating the movement to the case is promoted.

Further, a module removing recessed portion is provided at a face of the fitting projected portion on a side of the cover glass. The module is made to be able to remove from the case by deforming the elastically deformed portion of the housing to an inner diameter direction by pressing a fitting releasing jig to the recessed portion from outside of the case.

BRIEF DESCRIPTION OF THE DRAWINGS

A preferred embodiment of the invention will now be described with reference to the accompanying drawings wherein.

DETAILED DESCRIPTION OF THE PREFERRED EMBODIMENTS

Figure 1:
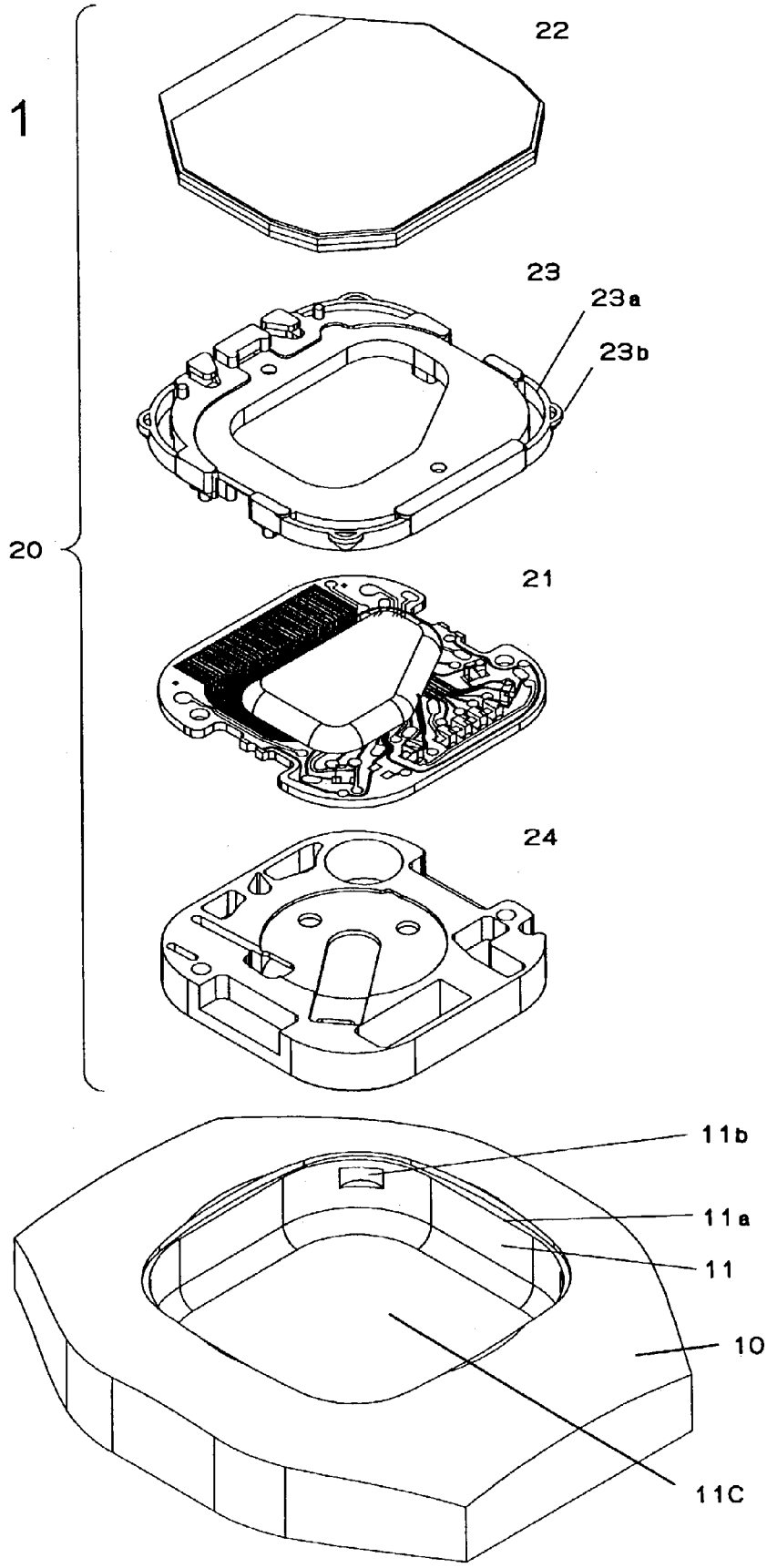
FIG. 1 is a disassembled perspective view of a timepiece according to an embodiment of the invention.

According to a timepiece in one embodiment of the present invention, as shown by a disassembled view in FIG. 1, a module 20 is fixed to a case 10 by fitting the fitting projected portions 23*b* formed at a side face of a housing made of a resin constituting a portion of the module 20 to a plurality of engaging recessed portions 11*b* formed at an inner side face 11 of the case 10 having one-piece structure integrated with a case band and a case back. The housing is preferably made of resin and comprises a first housing 23 and a second housing 24 for containing or attaching constituent parts of the module 20. In FIG. 1, the fitting projected portions are provided at a portion of an elastically deformed portion 23*a* in a shape of a two-sided supporting beam formed integrally with the first housing 23 and being deformable in a planar direction.

Figure 2:
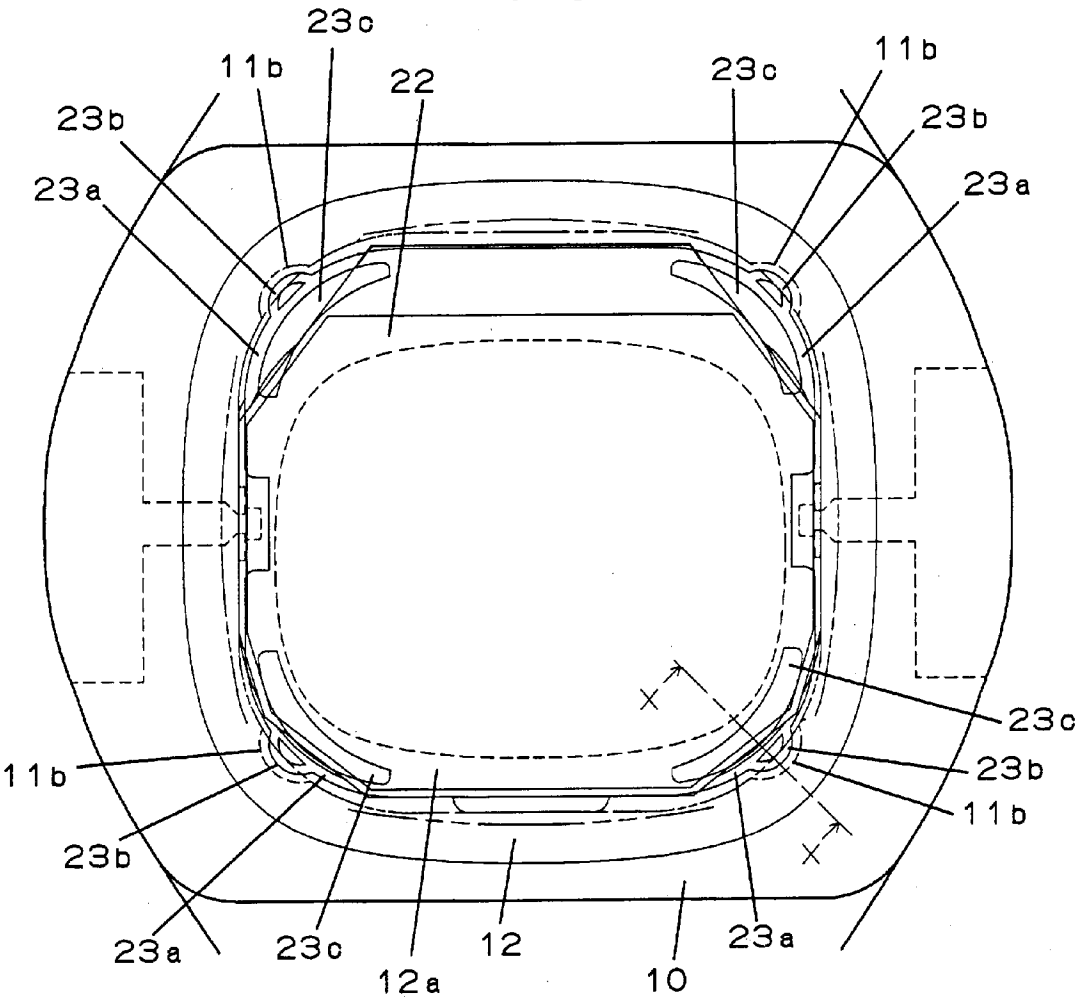
FIG. 2 is a plane view of the timepiece according to the embodiment of the invention.
Figure 3:
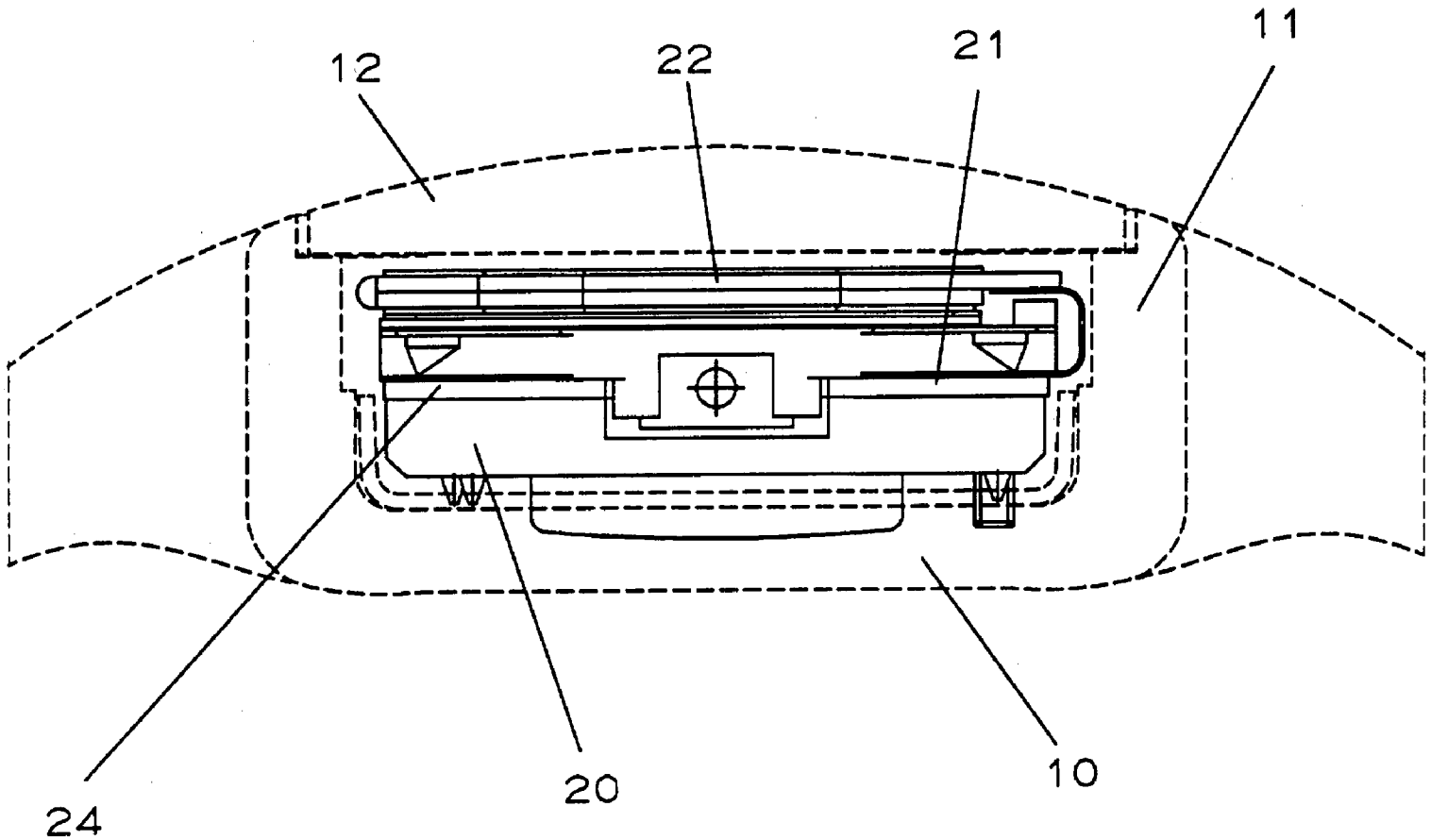
FIG. 3 is a sectional view of the timepiece according to the embodiment of the invention.
Figure 4:
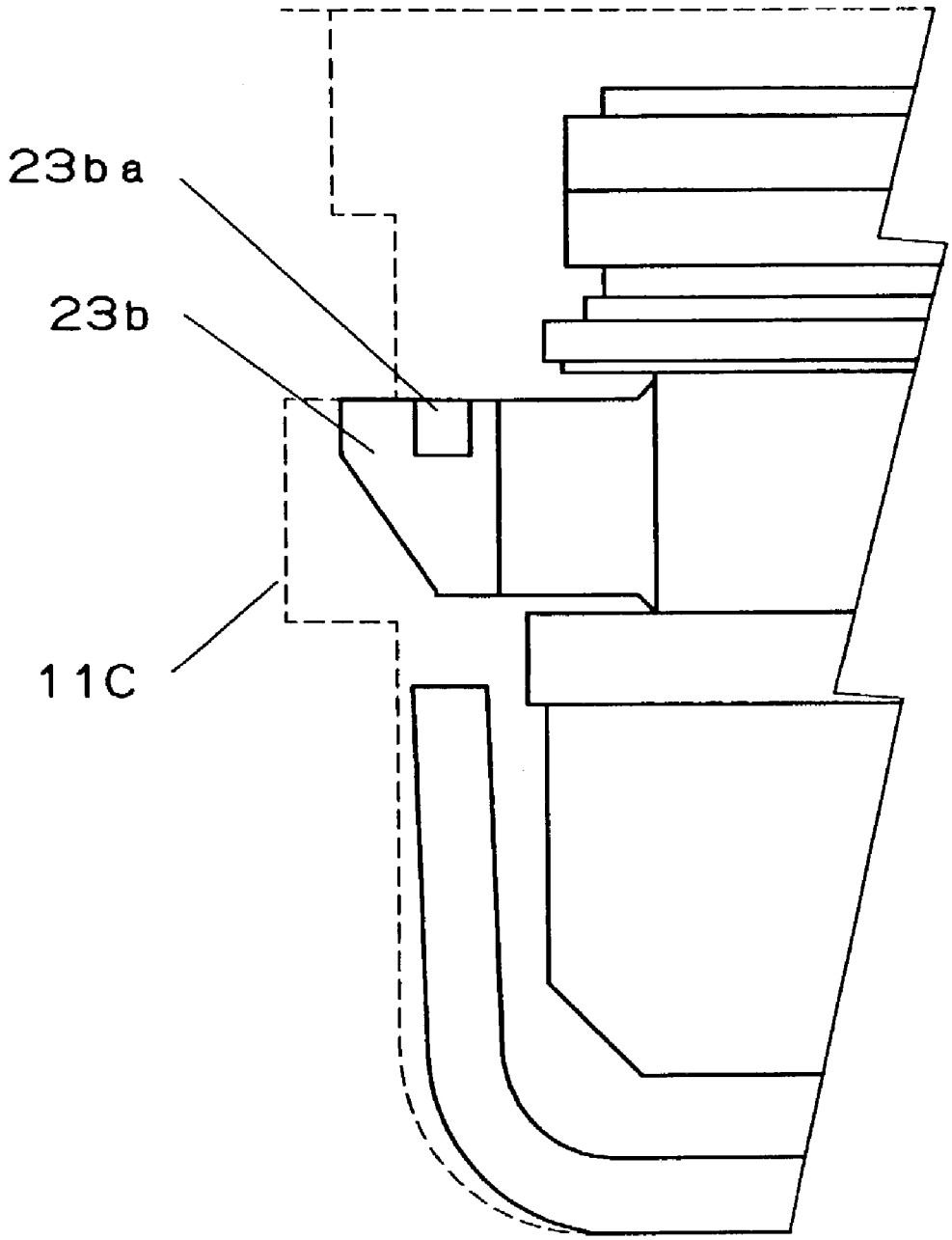
FIG. 4 is a partial sectional view cut by a line X—X of FIG. 2.

That is, as shown by the disassembled view in FIG. 1, and in a plane view in FIG. 2, a sectional view cut in a strap length direction in FIG. 3 and a partial sectional view in FIG. 4, respectively, the timepiece according to the presently described embodiment of the invention is constructed with the case 10 integrated with the case band and the case back and having an only opening portion 11*c* on a surface side, the module 20 having the first housing 23 made of resin and contained in the case 10 and cover glass 12 for covering the opening portion 11*c* of the case.

Since the case 10 is the case having the one-piece structure integrated with the case band and the case back, a containing portion thereof for containing and fixing the module 20 is a one-bag-like containing portion. According to the timepiece of the embodiment of the invention, the one-bag-like containing portion is a cylindrical containing portion having the substantially rectangular opening portion 11*c* with four corners thereof in a circular arc shape. A plurality of the engaging recessed portions 11*b* are formed at an inner side face of the one-bag-like containing portion, that is, the inner side face 11 of the case 10. According to the timepiece of the embodiment of the invention, the plurality of engaging recessed portion 11*b* are formed by four pieces respectively at the four corners of the inner side face 11 of the case 10.

According to the timepiece of the embodiment of the invention, the module 20 is constituted by a circuit block 21, a liquid crystal display element 22, the first housing 23 and the second housing 24. The circuit block 21 is constituted by mounting various electronic parts constituting an electronic timepiece on a circuit board. The circuit block 21 held between a lower face of the first housing 23 and an upper face of the second housing 24 made of resin and the liquid crystal display element 22 electrically connected to the circuit block 21 is held on an upper face of the first housing 23. A planar shape of the module 20 successively laminated and integrated with the liquid crystal display element 22, the first housing 23, the circuit block 21 and the second housing constitutes the substantially rectangular module with the four corners in the circular arc shape.

The side face of the first housing 23 is provided with a plurality of the elastically deformable portions 23*a* in the shape of the two-sided supporting beam deformable in the planar direction. In the timepiece of the presently described embodiment of the invention, four of the elastically deformable portions 23*a* of the two-sided supporting beam are provided and are integrally formed with the housing by providing through holes 23*c* in a crescent shape at each of the four corners of the first housing 23.

The fitting projected portion 23*b* is formed at a portion of the elastically deformable portion 23*a* of the two-sided supporting beam. The fitting projected portion 23*b* is a projection in a tapered shape or a projection in a shape of an inverse cone spreading or opening in the direction of a side of the cover glass 12, that is, the side of the opening portion 11*c*. By having such a shape, when the module 20 is integrated to the containing portion of the case 10, only an apex of a circular arc of the fitting projected portion 23*b* is brought into contact with the inner side face 11 of the case 10 and therefore, when the module is contained, the elastically deformed portion 23*a* is smoothly deformed and integrating performance is promoted.

A face of the fitting projected portion 23*b* on a side of the cover glass 12 is provided with a removing recess 23*b*. There is a case of removing the module 20 temporarily contained in the case 10 from the case 10 depending on a situation of fabricating steps. At that occasion, the elastically deformed portion 23*a* in the shape of the two ends supporting beam is planarly deformed by touching a front end of an engagement releasing jig of a tweezers or the like to the removing recess 23*ba* to thereby release the fitting between the fitting projected portion 23*b* and the engaging recessed portion 11*b*.

A procedure of containing and stably fixing the module 20 to the case 10 will be explained as follows. According to the embodiment of the invention, the module 20 is constituted by holding the circuit block 21 shown by the disassembled view in FIG. 1 between the first housing 23 and the second housing 24 made of resin and integrating the liquid crystal display element 22 to the circuit block 21.

When the module 20 is moved down to integrate the module 20 constituted in this way from the side of the cover glass 12 into the case 10, the highest position of the inner side face 11 of the case and the fitting projected portion 23*b* provided at the first housing 23 made of resin are brought into contact with each other. When a pressing force is further exerted on the module 20, the fitting projected portion 23*b* in the tapered shape spreading toward the outside of the cover glass 12 has a planar force planarly directed imposed thereon toward the center of the case to thereby planarly deform the elastically deformed portion 23*a* of the two-sided supporting beam formed at the first housing made of resin. Then an amount of protrusion of the fitting projected portion 23*b* formed at the portion of the elastically deformed portion 23*a* in the shape of the two-sided supporting beam from an outer periphery of the module 20 is reduced.

By continuing to press further, the module 20 sinks to a side opposed to the cover glass 12 and, at the same time, the fitting projected portion 23*b* moves toward the center of the case 10. When an outermost periphery of the fitting projected portion 23*b* coincides with the inner side face 11 of the case 10, planar deformation of the elastically deformed portion 23*a* of the two-sided supporting beam is stopped and the first housing 23 is moved along the inner side face 11 of the case.

When a predetermined sectional moving amount is reached, the fitting projected portion 23*b* reaches the engaging recessed portion 11*b* provided at the inner side face 11 of the case, the elastically deformed portion 23*a* returns to the original shape by the elasticity and also the fitting projected portion 23*b* is settled to a position on an outer side of the outer periphery of the module 20.

As described above, when the module 20 is integrated to the containing portion of the case 10, the elastically deformed portion 23*a* in the shape of the two-sided supporting beam is planarly deformed in the direction of the center of the case 10 since the fitting projected portion 23*b* is pressed by the inner side face 11 of the case 10. Since the elastically deformed portion 23*a* has the two-sided supporting beam, a deformation amount thereof can be made larger than that of the conventional fitting projection having the cantilever structure. This means that a fitting amount when elastic deformation is released and the fitting projected portion and the engaging recessed portion are fitted to each other is increased.

Therefore, when the module 20 is integrated to the containing portion of the case 10, it is extremely easy to deform the elastically deformed portion 23*a* such that an outer peripheral face of the module 20 and the apex of the fitting projected portion 23*b* coincides with each other. Further, when the elastically deformed portion 23*a* in the shape of the two-sided supporting beam formed in this way returns to the original shape when the fitting projected portion 23*b* is fitted to the engaging recessed portion 11*b*. Thereby, the module 20 is contained and stably fixed to the containing portion of the case 10 having the one-piece structure integrated with the case band and the case back.

Meanwhile, as is apparent from the plane view of FIG. 2, according to the invention, the module 20 is stably fixed to the case 10 having the one-piece structure and the thickness between the inner side face and the outer side face of the case 10 is thinner than that of the conventional timepiece of this type. This is because the module fixing structure according to the invention is constituted by the plurality of engaging recessed portions 11*b* formed at the inner side face 11 of the case 10 and the fitting projected portions formed at the outer periphery of the housing 23 made of resin of the module 20 which are the fitting projected portions 23*b* formed at portions of the elastically deformed portions 23*a* in the shape of the two-sided supporting beam formed integrally with the outer periphery of the housing 23 made of resin. In this way, the amount of projection from the housing made of resin to the outer periphery is constituted only by the amount that the fitting projection 23*b* projects so as to be fitted to the engaging recessed portion 11*b* provided at the inner side face of the case 10. Therefore, special means for concealing a total of the hook portion constituting the fitting portion, for example, concealing the outer periphery of the module by a dial or a bezel which has been needed in the conventional timepiece of this kind, is dispensed with. Incidentally, according to the plane view of FIG. 2, the concealment of the fitting portion is realized by making an outer peripheral face of a display face 12*a* of the cover glass 12 opaque, however, the opaque portion is much smaller than that in the conventional timepiece. In this way, according to the invention, the module 20 can be contained and stably fixed to the containing portion of the case 10 without covering the outer periphery of the module 20.

Further, in FIG. 1 and FIG. 2, there is provided the module fixing structure having four sets of portions of fitting the engaging recessed portion 11*b* and the fitting projected portions 23*b*, however, a module fixing structure having three sets of the fitting positions can be constituted. Further, the module fixing structure can also be realized by two sets of the fitting portions by constituting a structure in which the module 20 is not inclined to the case 10. The module fixing structure achieving the inclination preventing operation is a structure in which, for example, two sets of the portions of fitting the engaging recessed portions 11*b* and the fitting projected portions 23*b* are provided at positions symmetrical with each other relative to a center point of the case and a fitting area thereof is extended in a circumferential direction.

Further, the module 20 includes not only an electronic timepiece module having a liquid crystal display element but also a movement of a mechanical timepiece or an electromechanical timepiece.

The invention can provide a module fixing structure which is a module fixing structure for solidly and stably fixing a module to a case in a timepiece integrating and fixing the module from an opening portion for containing the module on a side of cover glass in the case having a one-piece structure integrated with a case band and a case back and a module fixing structure making a thickness between an inner side face and an outer side face of the case considerably thinner than that of the conventional timepiece of this type. Therefore, in the case of a timepiece having a display face the same as that of a conventional timepiece of this type, small-sized formation of the case and small-sized formation of the timepiece can be realized. Further, in the case of a timepiece having a case of a size the same as that of a conventional timepiece of this type, large-sized formation of a display face can be realized.

According to a module fixing structure of the invention, a module is fixed to a case by fitting the fitting projected portions formed at portions of elastically deformed portions in a shape of a two ends supporting beam integrally formed at a side face of the housing made of resin for holding the module and deformed in a planar direction to a plurality of engaging recessed portions formed at an inner side face of the case having a one-piece structure integrated with a case band and a case back. Therefore, fabrication cost of the housing is considerably reduced in comparison with that of a conventional module fixing structure having an elastically deformed portion in a cantilever shape of this type.

Further, since the elastically deformed portion formed with the fitting projected portion at a portion thereof is an elastically deformed portion in a shape of a two ends supporting beam type deformed in a planar direction, in comparison with an elastically deformed portion in the cantilever shape adopted in a conventional module fixing structure of this type, a stable fitting projected portion which is difficult to the deformed plastically can be realized. Further, an amount of deforming the elastically deformed portion becomes larger than that of the elastically deformed portion in the cantilever shape adopted in the conventional module fixing structure of this type and therefore, integration or removal of the module is carried out more smoothly.

What is claimed is:

1. A timepiece comprising:

a case integrated with a wrist band and a case back, the case having an opening portion on a front surface side thereof;

a module having a housing formed of a resin and a timepiece movement held by the housing, the module being removably retained in the opening portion of the case; and a cover glass for covering the opening portion of the case;

wherein the housing has at least one two-sided supporting beam integrally formed in a side surface thereof and being deformable in a planar direction of the housing, and a fitting projection protruding from each two-sided supporting beam, and the module is fixed in the opening portion of the case by inserting the fitting projection into a corresponding engaging recess formed in an inner side face of the case.

2. A timepiece according to claim 1; wherein the at least one fitting projection and corresponding engaging recess comprises at least three fitting projections and three corresponding engaging recesses spaced apart from each other by predetermined intervals.

3. A timepiece according to claim 1; wherein the at least one fitting projection and corresponding engaging recess comprises two fitting projections and two corresponding engaging recesses opposed to each other to prevent inclination of the housing in the case.

4. A timepiece according to claim 1; wherein each fitting projection has a tapered shape tapering inwardly toward a center of the cover glass so that each two-sided beam deforms planarly while the housing is being pressed into the opening portion.

5. A timepiece according to claim 1; wherein each fitting projection has an inverted cone shape.

6. A timepiece according to claim 1; wherein a module removing recessed portion is provided in a face of the fitting projections on a side of the cover glass.

7. A timepiece according to claim 1; wherein the housing has rounded corners and a two-sided supporting beam is provided at each of the rounded corners by forming crescent-shaped holes in the housing such that the two-sided supporting beams are deformable in a planar direction.

8. A wrist-wearable device comprising: a module having a functional body and a housing for holding the functional body, the housing having rounded corners and elastically deformable portions along a side face of the housing at each of the rounded corners, the elastically deformable portions being formed by crescent-shaped holes in the housing to enable the elastically deformable portions to undergo deformation in a planar direction; and a wrist-wearable case having a case back, an opening for containing the module, and a cover for covering the opening portion of the case, the module being fixed to the case within the opening by pressing the module into the opening so that each elastically deformable portion is deformed in a planar direction inwardly toward a center of the case and becomes engaged by a corresponding engaging recess formed at an inner side face of the case.

9. A wrist-wearable device according to claim 8; further comprising a projection on each elastically deformable portion for engaging the engaging recess.

10. A wrist-wearable device according to claim 9; wherein each projection has an inverted conical shape so as to cause the elastically deformable portion to become deformed while the module is being pressed into the opening.

11. A wrist-wearable device according to claim 8; wherein the functional body comprises a timepiece movement.

12. A wrist-wearable device according to claim 8; wherein the housing is formed of a resin.

* * * * *